US008703021B1

(12) United States Patent
Kwong et al.

(10) Patent No.: US 8,703,021 B1
(45) Date of Patent: Apr. 22, 2014

(54) BASIC REFRACTORY AND SLAG MANAGEMENT FOR PETCOKE CARBON FEEDSTOCK IN GASIFIERS

(71) Applicants: Kyei-Sing Kwong, Albany, OR (US); James P. Bennett, Salem, OR (US); Jinichiro Nakano, Albany, OR (US)

(72) Inventors: Kyei-Sing Kwong, Albany, OR (US); James P. Bennett, Salem, OR (US); Jinichiro Nakano, Albany, OR (US)

(73) Assignee: U.S. Department of Energy, Washington, DC (US)

( * ) Notice: Subject to any disclaimer, the term of this patent is extended or adjusted under 35 U.S.C. 154(b) by 0 days.

(21) Appl. No.: 13/661,170

(22) Filed: Oct. 26, 2012

(51) Int. Cl.
*C01B 3/02* (2006.01)

(52) U.S. Cl.
USPC ..... 252/373

(58) Field of Classification Search
None
See application file for complete search history.

(56) References Cited

U.S. PATENT DOCUMENTS

| | | | | |
|---|---|---|---|---|
| 4,668,429 | A * | 5/1987 | Najjar | 252/373 |
| 4,952,380 | A * | 8/1990 | Najjar et al. | 423/210 |
| 5,338,489 | A * | 8/1994 | Jung et al. | 252/373 |
| 5,578,094 | A | 11/1996 | Brooker et al. | |
| 8,197,566 | B2 | 6/2012 | Meschter et al. | |

OTHER PUBLICATIONS

Nakano et al., "Phase Equilibria in Synthetic coal-Petcoke Slags (Al2O3—CaO—FeO—SiO2—V2O3) under Simulated Gasification Conditions," Energy Fuels 25 (2011).
Nakano et al.,"Crystallization of Synthetic Coal-Petcoke Slag Mixtures Simulating Those Encountered in Entrained Bed Slagging Gasifiers," Energy Fuels 23 (2009).
Wei et al., "Effect of Additives on Slag Properties in an Entrained Bed Gasifier," presented at World of Coal Ash (WOCA) conference, May 9-12, 2011, Denver, CO.
Zhang et al., "Review and Modeling of Viscosity of Silicate Melts: Part I. Viscosity of Binary and Ternary Silicates Containing CaO, MgO, and MnO," Metall. Mater. Trans. B 29B (1998).

* cited by examiner

*Primary Examiner* — Melvin C Mayes
*Assistant Examiner* — Douglas Call
(74) *Attorney, Agent, or Firm* — James B. Potts; Brian J. Lally; John T. Lucas

(57) ABSTRACT

The disclosure provides methods of operating a slagging gasifier using a carbon feedstock having a relatively high $V_2O_5$ to $SiO_2$ ratio, such as petcoke. The disclosure generates a combined chemical composition in the feed mixture having less than 25 wt. % $SiO_2$, greater than 20 wt. % $V_2O_5$, and greater than 20 wt. % CaO. The method takes advantage of a novel recognition that increased levels of $SiO_2$ tend to decrease dissolution of the $V_2O_3$ which forms under the reducing conditions of the gasifier, and utilizes the CaO additive to establish a chemical phase equilibria comprised of lower melting compounds. The method further provides for control based on the presence of $Al_2O_3$ and FeO, and provides for a total combined chemical composition of greater than about 5 wt. % MgO for use with refractory linings comprised of MgO based refractory brick.

15 Claims, 5 Drawing Sheets

BASIC REFRACTORY AND SLAG MANAGEMENT FOR PETCOKE CARBON FEEDSTOCK IN GASIFIERS

GOVERNMENT INTERESTS

The United States Government has rights in this invention pursuant to the employer-employee relationship of the Government to the inventors as U.S. Department of Energy employees and site-support contractors at the National Energy Technology Laboratory.

FIELD OF THE INVENTION

The disclosure relates to methods of operating a slagging gasifier using a carbon feedstock having a relatively high $V_2O_5$ to $SiO_2$ ratio, such as petroleum coke (petcoke), in conjunction with CaO and MgO additives.

BACKGROUND

The partial oxidation of solid carbonaceous fuels such as coal and/or petroleum coke (petcoke) to produce mixtures of CO and $H_2$ is a common practice. Within the gasifier, the carbonaceous feedstock is reacted with a controlled, substoichiometric quantity of oxygen in a—carbon rich environment. The specific operational processes vary depending on the type of gasifier employed and the desired CO and $H_2$ composition.

In a slagging gasifier, nonvolatile impurities from the feedstock coalesce and form a viscous slag. The gasifier temperatures are typically optimized between about 1325 and 1575° C. to allow the slag to flow down the refractory lined walls, avoiding clogging and premature shutdown, and minimizing degradation of the refractory materials lining the gasification chamber. The carbonaceous fuel utilized as feed is typically coal, or a mixture of coal and petcoke, with the composition of the resulting slag closely related to the nonvolatile impurities present in the feedstock. Typical coal ashes generally contain significant amount of silicon, -aluminum, and iron, with substantially no Vanadium. In contrast, petcoke ashes generally contain lesser amounts of silicon, and a significantly increased amount of Vanadium. In typical ash analysis the quantities are reported as a weight percent (wt. %) of the respective oxide formed under oxidizing conditions, such as silica ($SiO_2$), alumina ($Al_2O_3$), ferrous oxide (FeO), and vanadium pentoxide ($V_2O_5$), and under this nomenclature, coal ash compositions are generally comprised of about 45-50 wt. % $SiO_2$ and substantially no $V_2O_5$, while petcoke ash compositions are generally comprised of a reduced $SiO_2$ content and generally greater than about 20 wt. % $V_2O_5$. Additionally, coal contains approximately 10 wt. % nonvolatile impurities, whereas petcoke contains approximately 1 wt. % on average. As a result, in coal-petcoke mixtures, the overall slag quantity decreases as more petcoke is added, while the amount of petcoke slag in the dramatically increases.

The dramatic increase in petcoke slag as additional petcoke is utilized results in increased amounts of $V_2O_5$ entering the slagging gasifier as petcoke ash. This $V_2O_5$ is reduced to $V_2O_3$ under the reducing conditions of the gasifier, and correspondingly generates increased $V_2O_3$ levels in the resulting slag. Since $V_2O_3$ has a high melting point of about 1970° C., greater amounts of $V_2O_3$ in the slag will cause the melting temperature of the slag to increase. See e.g., Nakano et al., "Phase Equilibria in Synthetic Coal-Petcoke Slags ($Al_2O_3$—CaO—FeO—$SiO_2$—$V_2O_3$) under Simulated Gasification Conditions," *Energy Fuels* 25 (2011); and see Nakano et al., "Crystallization of Synthetic Coal-Petcoke Slag Mixtures Simulating Those Encountered in Entrained Bed Slagging Gasifiers," *Energy Fuels* 23 (2009). The presence of high melting temperature $V_2O_3$ in the slag has a significant impact on the resulting slag viscosity of the slag at typical operating temperatures, which is typically treated as a key parameter for gasifier operations. As a result, feedstock composition is often optimized based on the gasifier temperatures necessary in order to maintain a relatively low viscosity slag, in order to maintain satisfactory slag drainage and avoid clogging, premature shutdown, and material degradation, and correspondingly, the petcoke content of carbon feedstocks is typically limited when no additional additives are used. Viscosity can be decreased to increase slag flow by raising the gasification temperature, but this has the negative effect of increasing refractory wear in the gasifier lining, causing increased system downtime.

Various additives have been employed in order to increase the liquidity of slag generated by feedstocks having no or limited Vanadium content. Calcia (CaO) and magnesia (MgO) have been investigated in reducing environments on an ash mixture comprised of greater than about 40 wt. % $SiO_2$ and an absence of Vanadium, mixed with CaO contents between 5-20 wt. %. The CaO was found to decrease the melting temperature of the slag in highly reducing environments, with the magnitude of the decrease relatively constant irrespective of the wt. % of CaO added. See Wei et al., "Effect of Additives on Slag Properties in an Entrained Bed Gasifier," presented at World of Coal Ash (WOCA) conference, May 9-12, 2011, Denver, Colo. Additionally, for petcoke feedstocks having less than about 10 wt. % CaO in the glass forming compounds, addition of CaO at the rate of 0.2-0.4 pounds per ton of petcoke feedstock has been recommended. See U.S. Pat. No. 5,578,094 to Brooker et al. Additions of MgO and manganese oxide have also been reported. See U.S. Pat. No. 8,197,566 to Meschter et al. In all cases demonstrations were limited to ash compositions having an absence of Vanadium. Generally, when CaO has been utilized as an additive for gasifier operations, quantities have been relatively limited, and the impact of CaO on the viscosity of silicate melts has been limited to silicate structure alteration from a three-dimensional network to discrete anionic groups. See e.g., Zhang et al., "Review and Modeling of Viscosity of Silicate Melts: Part I. Viscosity of Binary and Ternary Silicates Containing CaO, MgO, and MnO," *Metall. Mater. Trans. B* 29B (1998), among others. Additionally, as is understood, CaO is extensively utilized in steelmaking for the neutralization of alumina, silica, sulfur, phosphorous, and other impurities typically found in metal ores, where Vanadium content is substantially absent.

Disclosed here is a method for the operation of a slagging gasifier using a carbon feedstock, where the carbon feedstock ash is relatively low in $SiO_2$ and comparatively high in Vanadium content, such as the composition typically found in petcoke. The method limits the $SiO_2$ content in the resulting slag in order to increase the $V_2O_3$ dissolution and limit $SiO_2$ interactions with basic oxides such as CaO and FeO, and additionally utilizes a CaO additive to increase the solubility of $V_2O_3$ into slag. The increased $V_2O_3$ dissolution generated by the reduced $SiO_2$ content in conjunction with the CaO additive acts to produce a slag of reduced viscosity and a reduced melting temperature for slags generated by high Vanadium content feedstocks, such as petcoke. The methodology thereby provides for the use of increased petcoke concentrations in carbon feedstocks utilized for the slagging gasifier, as well as allowing for slagging gasifier operations at reduced temperatures.

These and other objects, aspects, and advantages of the present disclosure will become better understood with reference to the accompanying description and claims.

SUMMARY

One or more embodiments of the present invention relate to a method for the operation of a slagging gasifier using a carbon feedstock and a CaO additive. The slagging gasifier is maintained under reducing conditions, with a temperature of from about 1200° C. to about 2000° C. and typically from about 1375° C. to about 1575° C., a pressure of from about 300 psi to about 1000 psi, and an oxygen partial pressure of from about $10^{-6}$ to about $10^{-11}$ atmospheres. The carbon feedstock and the CaO additive are injected into the gasifier at respective rates such that a combined chemical composition resulting from the ash forming species of the carbon feedstock and the CaO additive is comprised of less than 25 wt. % $SiO_2$, greater than 20 wt. % $V_2O_5$, and greater than 20 wt. % CaO. In an embodiment, the $V_2O_5/SiO_2$ ratio of greater than about 0.8.

The method has particular applicability of feedstocks comprised of ash species having relatively high $V_2O_5/SiO_2$ ratios, such as a typical petcoke. The method takes advantage of a novel recognition that increased levels of $SiO_2$ tend to decrease dissolution of the $V_2O_3$ which forms under the reducing conditions of the gasifier, and utilizes the CaO additive to lower a melting point of the $V_2O_3$-bearing slag and to increase the solubility of $V_2O_3$ into the slag. Increasing the presence of lower melting constituents in the slag while decreasing the presence of higher melting constituents has the advantage of allowing gasifier operations at a reduced temperature while concurrently providing for satisfactory drainage of slag generated by relatively high $V_2O_5$ feedstock, such as petcoke.

The method further provides for the control of the carbon feedstock and CaO additive combined composition based on the presence of other common ash components, such as $Al_2O_3$ and FeO. In an embodiment, the ash forming species of the carbon feedstock are further comprised of $Al_2O_3$, and the carbon feedstock and the CaO additive injection rates are established such that a combined $SiO_2$—$Al_2O_3$—CaO chemical composition is comprised of greater than about 20% wt. % CaO, and achieves a $SiO_2/Al_2O_3$ ratio greater than about 1.3 and less than about 9. In an additional embodiment, the ash forming species are comprised of FeO, and a combined FeO—CaO—$V_2O_5$ chemical composition is established with less than about 20 wt. % FeO, and having CaO/$V_2O_5$ ratio greater than about 0.25 and less than about 1.5. The method further provides for combined chemical compositions comprised of greater than about 5 wt. % MgO for use with refractory linings comprised of MgO based refractory brick to decrease refractory wear.

The novel process and principles of operation are further discussed in the following description.

DETAILED DESCRIPTION

Figure 1:
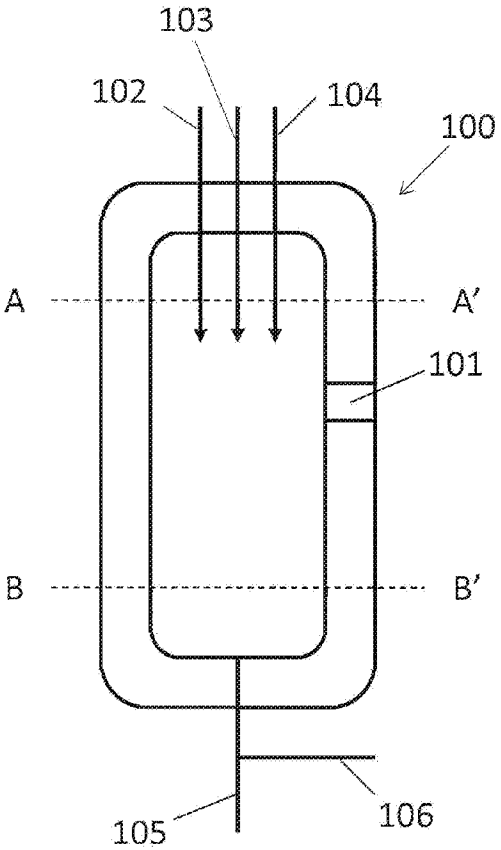
FIG. 1 illustrates an exemplary slagging gasifier configuration.

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a method for operating a slagging gasifier using a feedstock having a relatively high $V_2O_5$ to $SiO_2$ ratio in a low oxygen partial pressure environment.

The disclosure details methods of operating a slagging gasifier using a carbon feedstock having a relatively high $V_2O_5$ to $SiO_2$ ratio. The disclosure utilizes a CaO additive in order to generate a combined chemical composition in the feed mixture, where the combined chemical composition is less than about 25 wt. % $SiO_2$, greater than about 20 wt. % $V_2O_5$, and greater than about 20 wt. % CaO. The method limits the quantity of $SiO_2$ in order to mitigate $SiO_2$ interactions with the basic oxides CaO and FeO, such that the presence of the basic oxides provides for increased $V_2O_3$ dissolution in the resulting slag. The increased $V_2O_3$ dissolution mitigates the presence of $V_2O_3$ solids at typical gasifier temperatures and generates a lower viscosity slag.

The $SiO_2$ entering the gasifier is limited to 25 wt. % in order to generate a liquid slag having generally less than about 15 wt. % $SiO_2$. As is understood, petcoke and coal ash slags cover a wide range of mineralogical transformations and do not have the distinct melting point associated with pure materials. Rather, decreases in melting points when discussed with petcoke and coal ashes are typically correlated with by decreasing viscosity. As the temperature is increased the slag becomes less viscous or more liquid like, and reactions occur as various constituents become more fluid and start to dissolve the other non-molten materials. Within this disclosure, the $SiO_2$ content of the carbon feedstock is limited in order to produce a reduced $SiO_2$ liquid slag, such that CaO introduced by a CaO additive is available to, increase the dissolution of $V_2O_3$ resulting from the high Vanadium content carbon feedstock.

The method takes advantage of a novel recognition that increased levels of $SiO_2$ tend to decrease dissolution of the $V_2O_3$ which precipitates out under the reducing conditions of the gasifier, and utilizes the CaO additive to establish a chemical phase equilibria comprised of lower melting slag. Increasing the presence of lower melting constituents in the slag while decreasing the presence of higher melting constituents has the advantage of allowing gasifier operations at a reduced temperature while concurrently providing for satisfactory drainage of slag generated by relatively high $V_2O_5$ feedstock, such as petcoke.

The method further provides for the control of the carbon feedstock and CaO additive combined chemical composition based on the presence of other common ash components, such as $Al_2O_3$ and FeO. The method additionally provides for combined chemical compositions comprised of greater than about 5 wt. % MgO for use with refractory linings comprised of MgO based refractory brick, in order to decrease refractory wear due to the formation of a small amount of MgO-containing phases. The mitigation of $V_2O_3$ solids in the slagging gasifier of this disclosure as well as the formation of lower melting slag through the use of the CaO additive acts to generate a lower viscosity slag having acceptable flow performance at reduced gasifier temperatures.

FIG. 1 illustrates an exemplary slagging gasifier generally indicated at 100. Slagging gasifier 100 includes a reaction zone between axis A-A' and B-B', and a refractory liner in the reaction zone comprised of refractory brick, such as refractory brick 101. During operation, the reaction zone is injected with fuel at 102, water at 103, and gas at 104. The fuel is generally a carbon feedstock such as coal, coke, char, or other carbonaceous fuel, the water is typically in the form of steam or a liquid which enters as a component of a fuel slurry, and the gas is some gas comprised of oxygen. The carbon feedstock is heated and undergoes a pyrolysis process on entering the reaction zone, and the carbon feedstock, water, and oxygen comprising the gas subsequently mix and interact in the reaction zone. "Water" as the term is used here may refer to steam, liquid water, or various combinations thereof.

The reaction zone is maintained at a temperature and pressure such that when the carbon feedstock, water, and oxygen mix in the reaction zone, a gasification process occurs as the volatile products and some of the carbon feedstock reacts with oxygen to form carbon dioxide and carbon monoxide. Gasification subsequently occurs as the carbon feedstock reacts with carbon dioxide and steam to produce carbon monoxide and hydrogen. Additionally, some degree of water gas shift balances the concentrations of carbon monoxide, steam, carbon dioxide and hydrogen. The necessary heat for this process may be provided by an external source in an allothermal process, or the process may be autothermal, where heat is provided by the exothermal chemical reactions occurring inside the gasifier itself. The gasification process generally operates at temperatures between 1325° C. and 1575° C. and pressures between 300 psi to 1000 psi, with oxygen partial pressures generally between $10^{-6}$ and $10^{-10}$ atm within the reaction zone.

The gaseous products of the chemical reactions in the reaction zone exit slagging gasifier 101 at outlet 106. Non-volatile mineral components in the carbon feedstock form a slag. The slag generated in the reaction zone of slagging gasifier 101 is drawn by gravity toward slag tap 105 and during transit contacts the refractory liner under the pressure and temperature conditions of the reaction zone.

In many applications the carbon feedstock utilized is a mixture of coal and petcoke where, as discussed, the addition of petcoke is limited in order to avoid a slag composition comprised of significant amounts of $V_2O_3$ as a solid in the slag. Generally, coal ash contains over 40 wt. % $SiO_2$ and a relative absence of $V_2O_5$, while petcoke ash composition may be on the order of around 10 wt. % $SiO_2$ and around 40 wt. % $V_2O_5$. The typical approach in formulating feedstocks using coal-petcoke mixtures is to limit the petcoke in order to limit the $V_2O_5$ in the feedstock and $V_2O_3$ in the resulting slag. This practice also increases the $SiO_2$ content. The result is the generation of a slag with a $SiO_2$ content that is relatively high, and a $V_2O_3$ content which is at least acceptably low, based on the desired flow characteristics of the resulting slag.

One of the recognitions of this disclosure is the impact of the increased $SiO_2$ on the dissolution of $V_2O_3$ in the resulting slag. Phase diagrams indicate that $V_2O_3$ has limited interactions in the slag with $SiO_2$. However, $V_2O_3$ can easily dissolve into mixtures of the basic oxides CaO and FeO at relatively low temperatures. Inventors have recognized that in typical coal-based slags, $SiO_2$ interactions with the basic oxides CaO and FeO act to generate a slag having a limited availability of CaO and FeO, which tends to reduce the ability to dissolve $V_2O_3$ in the slag. As a result, the larger the amount of $SiO_2$ in the slag, the smaller the amount of $V_2O_3$ dissolved. The decreased $V_2O_3$ dissolution results in a relatively high concentration of $V_2O_3$ solids at typical gasifier temperatures and produces a high viscosity slag.

Figure 2:
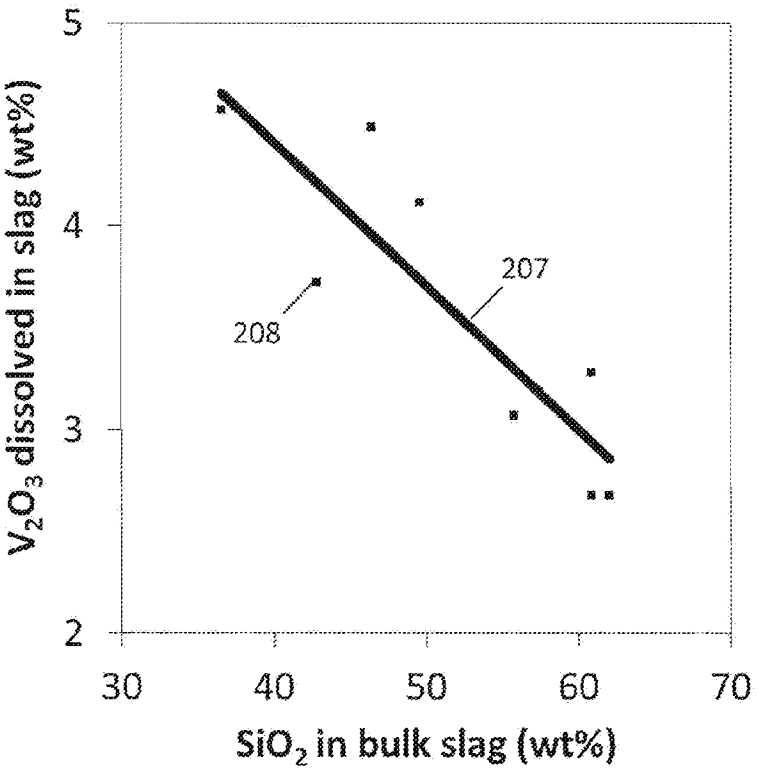
FIG. 2 illustrates the impact of $SiO_2$ on $V_2O_3$ dissolution in the $Al_2O_3$—CaO—FeO—$SiO_2$—$V_2O_3$ system.

As an example, FIG. 2 illustrates the dissolution of $V_2O_3$ as $SiO_2$ increases. FIG. 2 indicates behavior in slag of the $Al_2O_3$—CaO—FeO—$SiO_2$—$V_2O_3$ system, using slags comprised of about 36-62 wt. % $SiO_2$, about 13 wt. % FeO, about 8 wt. % CaO, and about 3-8 wt. % $V_2O_3$. At FIG. 2, trend line 207 approximates the location of a collection of data points, such as data point 208. Vanadium solubility in the slag was measured by SEM-WDX on quenched samples after 3 days of equilibration at 1500° C. in $Po_2=10^{-8}$ atm. As indicated, as the $SiO_2$ content increases, the solubility of $V_2O_3$ in the slag decreases significantly. For example, at FIG. 2, reducing the content of $SiO_2$ from around 60 wt. % to around 35 wt. % increases $V_2O_3$ dissolution in the 3-8 wt. % $V_2O_3$ slag by about 40%, from around 2.8 wt. % to about 4.8 wt. %. Correspondingly, in the $Al_2O_3$—CaO—FeO—$SiO_2$—$V_2O_3$ slags generated in the reducing gasifier operations of this disclosure, limiting the $SiO_2$ content of the generated slags acts to increase the dissolution of $V_2O_3$ solids in the slag and decrease the slag viscosity. This has the practical effect of allowing for increased quantities of $V_2O_5$ in the carbon feedstock utilized for the gasifier while continuing to generate slags having sufficient drainage characteristics. For example, utilizing a carbon feedstock comprised of an increased percentage of petcoke, or substantially all petcoke.

In conjunction with the effect of decreased $SiO_2$ and the correspondingly increased dissolution of $V_2O_3$ in the slag, the disclosure additionally utilizes a CaO additive or CaO-based additive comprised of a quantity of CaO in order to lower the melting points of the resulting slag system. The presence of CaO combined with the increased dissolution of $V_2O_3$ acts to establish a lower melting chemical phase equilibria and mitigates the presence of higher melting constituents such as $V_2O_3$, as well as others. Increasing the presence of lower melting constituents in the slag while decreasing the presence of higher melting constituents has the advantage of allowing gasifier operations at a reduced temperature while concurrently providing for satisfactory drainage of slag generated by relatively high $V_2O_5$ feedstock.

The disclosure provides a method of operating a slagging gasifier such as slagging gasifier 100 when the reaction zone between axis A-A' and B-B' is maintained at a temperature of from about 1200° C. to about 2000° C., a pressure of from about 300 psi to about 1000 psi, and an oxygen partial pressure of from about $10^{-6}$ to about $10^{-11}$ atmospheres. The method injects a carbon feedstock into the gasifier at a feedstock injection rate. The carbon feedstock, such as petcoke or a petcoke/coal mixture, is comprised of ash forming species, where the ash forming species are comprised of $SiO_2$ and $V_2O_5$. Concurrently, as is understood, water and an oxygen-containing gas is introduced. In conjunction with the injection of the carbon feedstock, a CaO additive comprised of a quantity of CaO is concurrently injected at, an additive injection rate. The feedstock injection rate and the additive injection rate are maintained such that the ash forming species and the quantity of CaO entering, the slagging gasifier have a combined chemical composition such that the combined chemical composition is comprised of less than 25 wt. % $SiO_2$, greater than 20 wt. % $V_2O_5$, and greater than about 20 wt. % CaO. Under the slagging gasifier conditions, the $V_2O_5$ is reduced to $V_2O_3$, and the presence of $SiO_2$ and CaO within the limits specified provides for increased dissolution of $V_2O_3$ and generation of a relatively low viscosity slag. Typically, the carbon feedstock and CaO additive are mixed to some degree prior to injection of either into slagging, gasifier 100, and the relative feedstock and additive injection rates are established and maintained based on an initial mixture ratio in the combined feed. In an embodiment, the feedstock injection rate and the additive injection rate are maintained such a CaO—$SiO_2$—$V_2O_5$ chemical composition is comprised of greater than about 40 wt. % CaO, and has a $V_2O_5/SiO_2$ ratio of greater than about 1.5.

Within this disclosure, the "combined chemical composition" means a chemical composition consisting of all oxides which originate in the ash forming species and the CaO in the quantity of CaO, such that 100 wt. % of the combined chemical composition is the weight percent achieved when the all oxides of the ash forming species and the CaO in the quantity of CaO are combined. Correspondingly, a combined chemical composition having a particular weight percent of $SiO_2$, $V_2O_5$, and CaO is referenced to the 100 wt. % of the total combined chemical composition.

Similarly, within this disclosure, the "CaO—$SiO_2$—$V_2O_5$ chemical composition" means a chemical composition consisting of $SiO_2$, $V_2O_5$, and CaO which originates in the ash forming species and the quantity of CaO, such that 100 wt. % of the CaO—$SiO_2$—$V_2O_5$ chemical composition is the weight percent achieved when the $SiO_2$, $V_2O_5$, and CaO of the ash forming species and the quantity of CaO are combined. Correspondingly, a combined CaO—$SiO_2$—$V_2O_5$ chemical composition having a particular weight percent CaO is referenced to the 100 wt. % of the combined CaO—$SiO_2$—$V_2O_5$ chemical composition.

Figure 4:
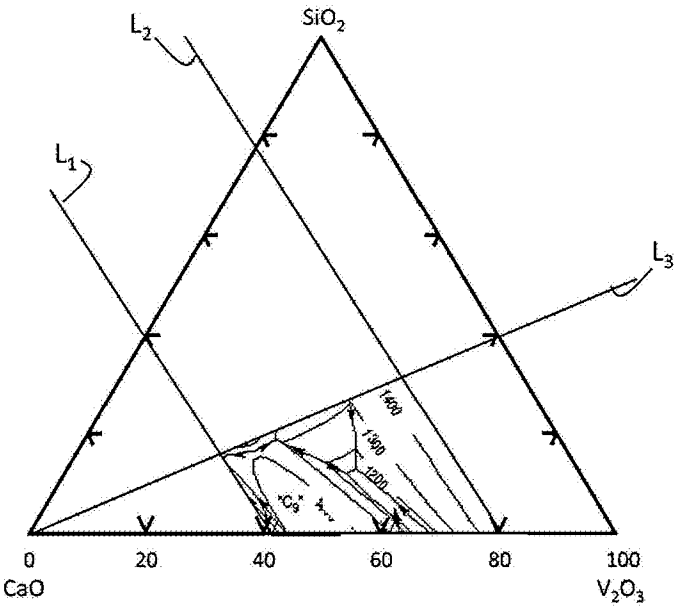
FIG. 4 PRIOR ART
FIG. 4 illustrates the ternary phase diagram of the CaO—$SiO_2$—$V_2O_3$ system utilizing the carbon feedstock and CaO additive.
Figure 3:
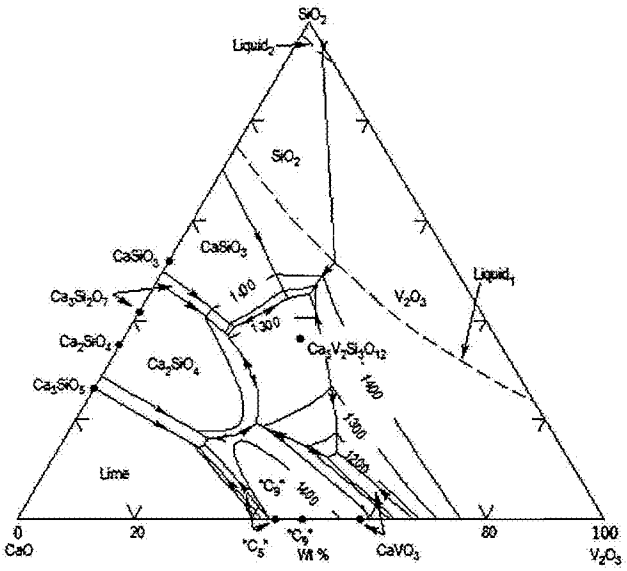
FIG. 3 illustrates a ternary phase diagram of the CaO—$SiO_2$—$V_2O_3$ system.

As stated, the specified $V_2O_5/SiO_2$ ratio acts to allow for increased dissolution of $V_2O_3$ in the resulting slag, and the presence of CaO acts to mitigate the presence of higher melting constituents. The $SiO_2$ content of the high vanadium content feedstock is limited to less than about 25 wt. % in order to generate a liquid slag having reduced $SiO_2$, typically less than 15 wt. %. This is illustrated at FIGS. 3 and 4. FIG. 3 is a ternary phase diagram of the CaO—$SiO_2$—$V_2O_3$ system, and as $V_2O_3$ content increases, melting temperatures generally decrease as CaO increases. The limitations of this disclosure generate a slag operating within the region of these lower melting compounds, by limiting $SiO_2$ and increasing CaO, so that an increased quantity of $V_2O_5$ in the feedstock can be tolerated. This is illustrated at FIG. 4, illustrating an area of liquid slag in the CaO—$SiO_2$—$V_2O_3$ system bounded by $L_1$, $L_2$, and $L_3$. At FIG. 4, $L_1$ represents a CaO content of about 60 wt. % in the liquid slag, $L_2$ represents a CaO content of about 20 wt. % in the liquefied slag, and $L_3$ represents a $V_2O_3/SiO_2$ ratio of approximately 1.5 in the combined CaO—$SiO_2$—$V_2O_5$ chemical composition. Operation of the gasifier within the limitations of this disclosure is intended to generate a liquid slag generally between $L_1$ and $L_2$, and below $L_3$. As indicated, the decreased $SiO_2$ content of the slag and the addition of CaO to achieve the defined parameters allows generation of a slag where the limited $SiO_2$ content limits $SiO_2$ interactions with the basic oxide CaO, such that remaining CaO may increase dissolution of $V_2O_3$ through the generation of lower melting compounds. Operation within the limitations of this disclosure provides the advantage of allowing for increased petcoke concentrations in the carbon feedstock with reduced gasifier temperatures, while continuing to generate a slag of sufficiently low viscosity. In an embodiment, the carbon feedstock is at least 70% petcoke on an ash basis, and may be substantially 100% petcoke.

It is understood that in the ternary diagrams such as FIGS. 3 and 4, the ratios and weight percentages in the combined and CaO—$SiO_2$—$V_2O_5$ chemical compositions of the carbon feedstock and the CaO additive entering the gasifier do not directly translate to exactly equivalent quantities in the CaO—$SiO_2$—$V_2O_3$ system generated by the slag, due to the reduction of $V_2O_5$ to $V_2O_3$ under the reducing conditions of the gasifier, as well as other chemical alterations. The ternary diagrams such as FIGS. 3 and 4 are present for illustrative purposes only, and while representative they do not define the limitations of this disclosure. Within this disclosure, intended limitations are those described by the weight percents and ratios established in given combined compositions. Similarly, the ternary diagrams of FIGS. 5, 6, 7, 8 are likewise illustrative in nature and not intended to define the limitations of this disclosure.

Further, within this disclosure, when the CaO additive is comprised of a quantity of CaO, the quantity of CaO consists of any CaO present in the CaO additive as well as any CaO which forms by the dissociation in the gasifier environment of any compounds present in the CaO additive. For example, dolomite ($CaMg(CO_3)_2$), calcium carbonate ($CaCO_3$), calcium hydroxide ($Ca(OH)_2$), and typical steelmaking slags are comprised of a quantity of CaO within this disclosure.

Additionally, within this disclosure, "slagging gasifier" means a gasifying vessel into which coal, petcoke, or other carbonaceous fuel is introduced and gasified under high pressure and temperature by means of oxygen and water introduced into the gasifying vessel through tuyeres, and where residual ash collects as molten slag in a hearth of the gasifying vessel, where the molten slag is at least periodically discharged through a slag tap outlet. See e.g., U.S. Pat. No. 4,340,397 to Schulz, U.S. Pat. No. 4,730,444 to Reichl, U.S. Pat. No. 4,195,978 to Anderson, U.S. Pat. No. 5,630,853 to Eales, U.S. Pat. No. 5,136,808 to Calderon, and U.S. Pat. No. 7,883,556 to Wintrell, among others.

Additionally, within this disclosure, "carbon feedstock" means a material comprised of carbon and ash forming species, where the ash forming species are inorganic and organometallic, non-combustible material comprised of at least $SiO_2$ and $V_2O_5$. For example, petcoke, or a mixture of petcoke and coal. Within this disclosure, when the ash forming species of the carbon feedstock are specified in terms of oxides such as $SiO_2$, $V_2O_5$, and CaO among others, this refers to quantities as listed in the bulk chemical composition of the carbon feedstock ash, where the ash forming species are indicated as oxides of the relevant metal in a resulting ash, and where the quantity of an individual ash forming species is expressed as a weight percent of all ash forming species in the carbon feedstock. As is understood, when the carbon feedstock is a mixture of materials, the ash forming species limitations of this disclosure apply to the resulting mixture.

Additionally, within this disclosure, "petcoke" means a solid comprised of carbon and ash forming species, where the ash forming species are comprised of less than about 30 wt. % $SiO_2$ and greater than about 20 wt. % $V_2O_5$. Petcoke generally refers to a carbonaceous material derived from the thermal conversion and cracking of liquid hydrocarbons in petroleum refining processes, and includes both the solid thermal decomposition product of high-boiling hydrocarbon fractions obtained in petroleum processing and the solid thermal decomposition product of processing tar sands. Such carbonization products include, for example, green, calcined, needle and fluidized bed petroleum coke.

Figure 6:
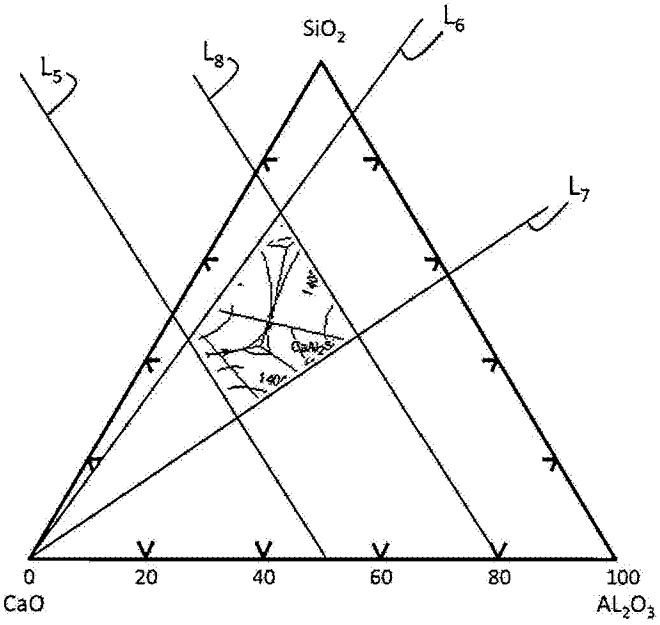
FIG. 6 PRIOR ART
FIG. 6 illustrates the ternary phase diagrams of the CaO—$SiO_2$—$V_2O_3$ system utilizing the carbon feedstock and CaO additive.
Figure 5:
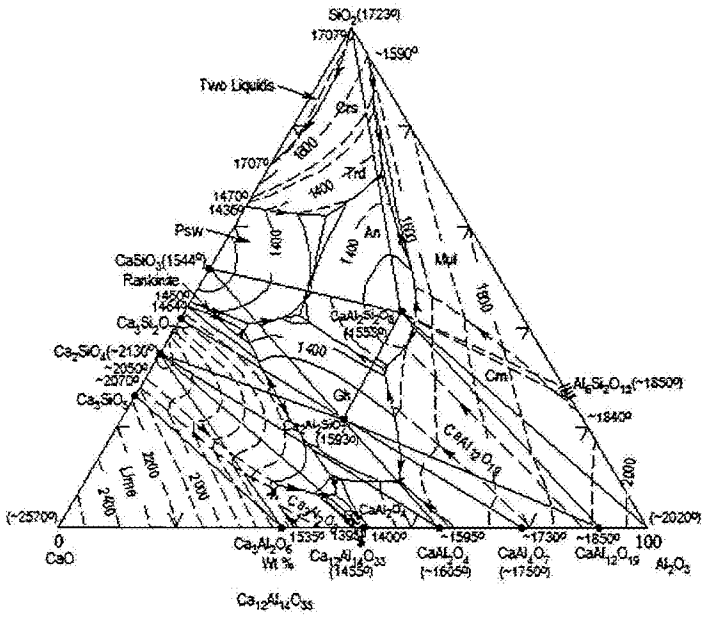
FIG. 5 illustrates a ternary phase diagrams of the CaO—$SiO_2$—$V_2O_3$ system.

In an embodiment, the ash forming species of the carbon feedstock are further comprised of $Al_2O_3$, and the feedstock injection rate and the additive injection rate are established such that a $SiO_2$—$Al_2O_3$—CaO chemical composition has a $SiO_2/Al_2O_3$ ratio greater than about 1.3 and less than about 9, and where the $SiO_2$—$Al_2O_3$—CaO chemical composition is comprised of greater than about 20 wt. % and less than about 50 wt. % CaO. This is intended to result in the generation of a slag illustrated at FIGS. 5 and 6, where FIGS. 5 and 6 are ternary phase diagrams of the $SiO_2$—$Al_2O_3$—CaO system. As illustrated at FIG. 5, at the higher CaO compositions of this disclosure, reduced melting temperature compounds may be formed by providing an increased quantity of CaO when $SiO_2$ and $Al_2O_3$ are present within certain ratios, as further indicated at FIG. 6. At FIG. 6, in the $SiO_2$—$Al_2O_3$—CaO system, $L_5$ represents a CaO content of about 50 wt. %, $L_6$ represents a $SiO_2/Al_2O_3$ ratio of approximately 9, $L_7$ represents a $SiO_2/Al_2O_3$ ratio of approximately 1.3, and $L_s$ represents a CaO content of about 20 wt. %. In this disclosure, when the feed injection rate and the additive injection rate are established to achieve specific weight percents and ratios in the $SiO_2$—$Al_2O_3$—CaO chemical composition, the $SiO_2$—$Al_2O_3$—CaO chemical composition is intended to generate a liquid slag generally in the region between $L_5$ and $L_8$ and between $L_6$ and $L_7$. In a further embodiment, the feedstock injection rate and the additive injection rate are established such a $SiO_2$—$V_2O_5$—$Al_2O_3$—CaO chemical composition has a $CaO/(SiO_2+V_2O_5+Al_2O_3+CaO)$ ratio greater than about 0.2 and less than about 0.5.

Within this disclosure, the "$SiO_2$—$Al_2O_3$—CaO chemical composition" means a chemical composition consisting of $SiO_2$, $Al_2O_3$, and CaO which originates in the ash forming species and the quantity of CaO, such that 100 wt. % of the $SiO_2$—$Al_2O_3$—CaO chemical composition is the weight percent achieved when the $SiO_2$, $Al_2O_3$, and CaO of the ash forming species and the quantity of CaO are combined. Similarly, within this disclosure, the "$SiO_2$—$V_2O_5$—$Al_2O_3$—CaO chemical composition" means a chemical composition consisting of $SiO_2$, $V_2O_5$, $Al_2O_3$, and CaO which originates in the ash forming species and the quantity of CaO, such that 100 wt. % of the $SiO_2$—$V_2O_5$—$Al_2O_3$—CaO chemical composition is the weight percent achieved when the $SiO_2$, $V_2O_5$, $Al_2O_3$, and CaO of the ash forming species and the quantity of CaO are combined.

Figure 8:
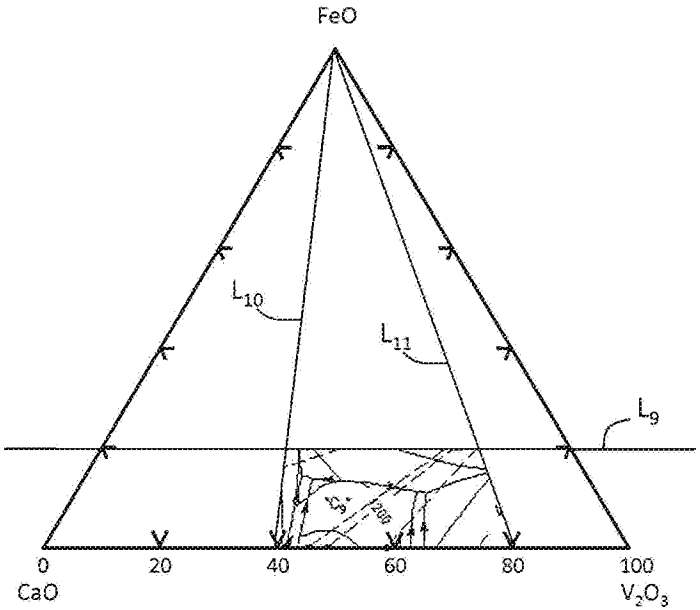
FIG. 8 PRIOR ART
FIG. 8 illustrates the ternary phase diagrams of the FeO—CaO—$V_2O_3$ system utilizing the carbon feedstock and CaO additive.
Figure 7:
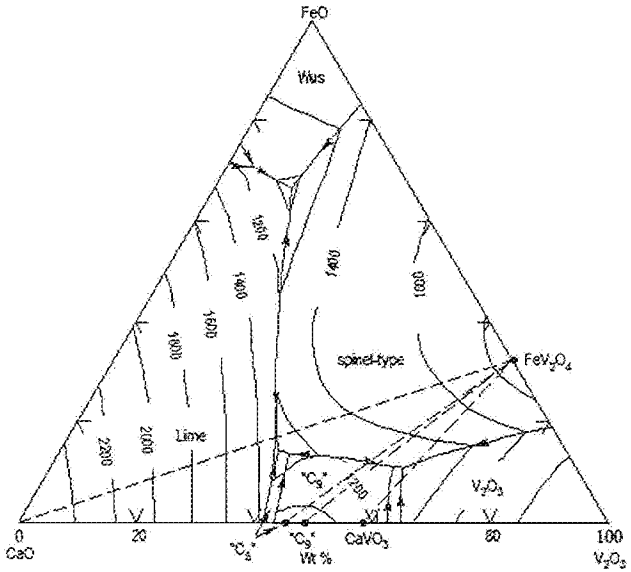
FIG. 7 illustrates a ternary phase diagrams of the FeO—CaO—$V_2O_3$ system.

In an additional embodiment, the ash forming species is further comprised of FeO, and the feedstock injection rate and the additive injection rate are established such that a FeO—CaO—$V_2O_5$ chemical composition of the ash forming species and the quantity of CaO is comprised of less than about 20 wt. % FeO, and such that the combined FeO—CaO—$V_2O_5$ chemical composition has a $CaO/V_2O_5$ ratio greater than about 0.25 and less than about 1.5. This is intended to result in the generation of a slag illustrated at FIGS. 7 and 8, where FIGS. 7 and 8 are ternary phase diagrams of the FeO—CaO—$V_2O_3$ system. As illustrated at FIG. 7, at the higher CaO compositions of this disclosure, reduced melting temperature compounds may be formed by limiting the FeO composition and the $CaO/V_2O_3$ ratios, as further indicated at FIG. 8. At FIG. 8, in the FeO—CaO—$V_2O_3$ system, $L_9$ represents a FeO content of about 20 wt. %, $L_{10}$ represents a $CaO/V_2O_3$ ratio of approximately 1.5, and $L_{11}$ represents a $CaO/V_2O_3$ ratio of approximately 0.25. In this disclosure, when the feed injection rate and the additive injection rate are established to achieve specific weight percents and ratios in the FeO—CaO—$V_2O_5$ chemical composition, the FeO—CaO—$V_2O_5$ chemical composition is intended to generate a liquid slag generally in the region bounded by $L_9$, $L_{10}$, and $L_{11}$.

Within this disclosure, the "FeO—CaO—$V_2O_5$ chemical composition" means a chemical composition consisting of FeO, $V_2O_5$, and CaO which originates in the ash forming species and the quantity of CaO, such that 100 wt. % of the combined FeO—CaO—$V_2O_5$ chemical composition is the weight percent achieved when the FeO. $V_2O_5$, and CaO of the ash forming species and the quantity of CaO are combined. Correspondingly, a combined FeO—CaO—$V_2O_5$ chemical composition having a particular weight percent FeO is referenced to the 100 wt. % of the combined FeO—CaO—$V_2O_5$ chemical composition.

In an embodiment, the CaO additive is further comprised of MgO, and the feedstock injection rate and the additive injection rate are established such that the combined chemical composition is further comprised of greater than about 5 wt. % MgO. In this embodiment, a refractory lining the reaction zone is comprised of MgO based refractory brick. Here, MgO based refractory brick means a refractory brick comprised of at least 60 wt. % magnesia. This is advantageous when the oxide specifications of this disclosure may generate undesired products when in contact with a specific type of refractory lining. For example, in some cases, chromium oxides present in the refractory may interact with a slag comprised of an increased CaO content to form $Cr^{6+}$. See e.g., Lee et al., "Minimization of Hexavalent Chromium in Magnesite-Chrome Refractory," *Metall. Mater. Trans. B* 28B (1997).

In an embodiment, the disclosure generates a slag having a CaO—$SiO_2$—$V_2O_3$ chemical composition with a CaO content of from about 20 wt. % to about 60 wt. % and having a $V_2O_3/SiO_2$ ratio of approximately 1.5 in the combined CaO—$SiO_2$—$V_2O_5$ chemical composition. The slag composition may be determined by various means known in the art, such as XRF spectrometry.

In a further embodiment, the ash forming species are comprised of $Al_2O_3$, and the feedstock injection rate and the additive injection rate are established to form a slag having a $SiO_2$—$Al_2O_3$—CaO chemical composition comprised of greater than about 20 wt. % and less than about 50 wt. % CaO and a $SiO_2/Al_2O_3$ ratio greater than about 1.3 and less than about 9. In another embodiment, the ash forming species is comprised of FeO, and the feedstock injection rate and the additive injection rate are established to form a slag having a FeO—CaO—$V_2O_3$ chemical composition comprised of less than about 20 wt. % FeO, and a $CaO/V_2O_3$ ratio greater than about 0.25 and less than about 1.5. Here, the "CaO—$SiO_2$—$V_2O_5$ chemical composition" means a chemical composition consisting of $SiO_2$, $V_2O_3$, and CaO which originates in the ash forming species and the quantity of CaO, such that 100 wt. % of the CaO—$SiO_2$—$V_2O_3$ chemical composition is the weight percent achieved when the $SiO_2$, $V_2O_3$, and CaO of the ash forming species and the quantity of CaO are combined. Similarly, the "FeO—CaO—$V_2O_3$ chemical composition" means a chemical composition consisting of FeO, CaO, and $V_2O_3$ which originates in the ash forming species and the quantity of CaO, such that 100 wt. % of the FeO—CaO—$V_2O_3$ chemical composition is the weight percent achieved when the FeO, CaO, and $V_2O_3$ of the ash forming species and the quantity of CaO are combined.

The means for introducing the carbon feedstock and the CaO additive may be any means sufficient to transport fuel to slagging gasifier 101 for subsequent pyrolysis to the carbon feedstock, such as high pressure injectors of fine particulate, or any other known system for the delivery of bulk material. The means for introduction of the gasifying medium comprised of water and oxygen may similarly be any mechanism or combinations sufficient for the delivery of water, steam, oxygen, air, or other gas comprised of oxygen, where the mechanism or combination exhibits sufficient control to establish and maintain partial oxidation in the reaction zone. For example, the means for introduction of the gasifying medium may be one or more fluid conduits having a flow throttling valve, where the flow throttling valve may be under automatic or manual control. The means for maintaining a temperature and a pressure in the reaction zone sufficient to generate the partial oxidation of the carbon feedstock may be the heat provided by the exothermal chemical reactions occurring inside the gasifier in an autothermal process, or may be an external powered source such as a heater or igniter in an allothermal process. Those skilled in the art understand that a gasification process in a reaction zone as described within this disclosure may utilize specific components over a wide variety of possible means.

The method thus discloses methods of operating a slagging gasifier using a carbon feedstock having a relatively high $V_2O_5$ to $SiO_2$ ratio, such as petcoke. The disclosure utilizes a CaO additive to generate a combined chemical composition in the feed mixture comprised of less than about 25 wt. % $SiO_2$, greater than about 20 wt. % $V_2O_5$, and greater than about 20 wt. % CaO. The method takes advantage of a novel recognition that increased levels of $SiO_2$ tend to decrease dissolution of the $V_2O_3$ which forms under the reducing conditions of the gasifier, and utilizes the CaO additive to establish a chemical phase equilibria comprised of lower melting compounds or slag. Increasing the presence of lower melting constituents in the slag while decreasing the presence of higher melting constituents has the advantage of allowing gasifier operations at a reduced temperature while concurrently providing for satisfactory drainage of slag generated by relatively high $V_2O_5$ feedstock. The method further provides for the control of the carbon feedstock and CaO additive combined composition based on the presence of other common ash components, such as $Al_2O_3$ and FeO, and provides for combined chemical compositions comprised of greater than about 5 wt. % MgO for use with refractory linings comprised of MgO based refractory brick, when, for example, increased refractory wear due to the addition of CaO may be a concern.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. A method of operating a slagging gasifier using a carbon feedstock and a CaO additive comprising:

maintaining the slagging gasifier at a temperature of from about 1200° C. to about 2000° C., and a pressure of from about 300 psi to about 1000 psi, and an oxygen partial pressure of from about $10^{-6}$ to about $10^{-11}$ atmospheres;

injecting a carbon feedstock into the gasifier at a feedstock injection rate, where the carbon feedstock is comprised of ash forming species, and where the ash forming species are comprised of less than about 25 wt. % $SiO_2$, greater than about 20 wt. % $V_2O_5$, and less than about 20 wt. % CaO;

injecting a CaO additive into the gasifier at an additive injection rate, where the CaO additive is comprised of CaO, thereby injecting a quantity of CaO and thereby generating a combined chemical composition in the gasifier, where the combined chemical composition consists of the ash forming species and the quantity of CaO; and establishing the feedstock injection rate and the additive injection rate such that the combined chemical composition is comprised of less than about 25 wt. % $SiO_2$, greater than about 20 wt. % $V_2O_5$, and greater than about 20 wt. % CaO.

2. The method of claim 1 where the ash forming species is comprised of FeO, and further comprised of establishing the feedstock injection rate and the additive injection rate to form a slag having a FeO—CaO—$V_2O_3$ chemical composition comprised of less than about 20 wt. % FeO, and where the FeO—CaO—$V_2O_3$ chemical composition has a CaO/$V_2O_3$ ratio greater than about 0.25 and less than about 1.5.

3. The method of claim 2 and further comprised of establishing the feedstock injection rate and the additive injection rate to form the slag having a CaO—$SiO_2$—$V_2O_3$ chemical composition comprised of from about 20 wt. % to about 60 wt. % CaO, and where the CaO—$SiO_2$—$V_2O_3$ chemical composition has $V_2O_3$, $SiO_2$ ratio greater than approximately 1.5.

4. The method of claim 3 where the ash forming species are comprised of $Al_2O_3$, and further comprised of establishing the feedstock injection rate and the additive injection rate to form the slag having a $SiO_2$—$Al_2O_3$—CaO chemical composition comprised of greater than about 20 wt. % CaO and less than about 50 wt. % CaO, and where the $SiO_2$—$Al_2O_3$—CaO chemical composition has a $SiO_2/Al_2O_3$ ratio greater than about 1.3 and less than about 9.

5. The method of claim 1 where the ash forming species is comprised of FeO, and further comprised of establishing the feedstock injection rate and the additive injection rate such that a FeO—CaO—$V_2O_5$ chemical composition of the ash forming species and the quantity of CaO is comprised of less than about 20 wt. % FeO, and such that the FeO—CaO—$V_2O_5$ chemical composition has a CaO/$V_2O_5$ ratio greater than about 0.25 and less than about 1.5.

6. The method of claim 5 where the carbon feedstock is comprised of greater than 70% petcoke on an ash basis.

7. The method of claim 5 where the temperature is greater than about 1300° C. and less than about 1575° C.

8. The method of claim 5 further comprised of establishing the feedstock injection rate and the additive injection rate such that a CaO—$SiO_2$—$V_2O_5$ chemical composition of the ash forming species and the quantity of CaO has a $V_2O_5/SiO_2$ ratio of greater than about 1.5, and where the CaO—$SiO_2$—$V_2O_5$ chemical composition is comprised of greater than about 20 wt. % CaO and less than about 60 wt. % CaO.

9. The method of claim 5 where the ash forming species are comprised of $Al_2O_3$, and further comprised of establishing the feedstock injection rate and the additive injection rate such that a $SiO_2$—$Al_2O_3$—CaO chemical composition of the ash forming species and the quantity of CaO has a $SiO_2/Al_2O_3$ ratio greater than about 1.3 and less than about 9, and such that the $SiO_2$—$Al_2O_3$—CaO chemical composition is comprised of greater than about 20 wt. % CaO and less than about 50 wt. % CaO.

10. The method of claim 9 where the carbon feedstock is further comprised of $Al_2O_3$, and further comprised of establishing the feedstock injection rate and the additive injection rate such that a $SiO_2$—$V_2O_5$—$Al_2O_3$—CaO chemical composition has a $CaO/(SiO_2+V_2O_5+Al_2O_3+CaO)$ ratio is greater than about 0.2 and less than about 0.5.

11. The method of claim 5 further comprising;

generating a slag in a reaction zone of the gasifier; and contacting the slag and a refractory lining the reaction zone, where the refractory is comprised of MgO based refractory brick.

12. A method of operating a slagging gasifier using a carbon feedstock and a CaO additive comprising:

maintaining the slagging gasifier at a temperature of from about 1200° C. to about 2000° C., and a pressure of from about 300 psi to about 1000 psi, and an oxygen partial pressure of from about $10^{-6}$ to about $10^{-11}$ atmospheres;

injecting a carbon feedstock into the gasifier at a feedstock injection rate, where the carbon feedstock is comprised of ash forming species, and where the ash forming species are comprised of less than about 25 wt. % $SiO_2$, greater than about 20 wt. % $V_2O_5$, and less than about 20 wt. % CaO, and where the ash forming species is comprised of $Al_2O_3$ and FeO;

injecting a CaO additive into the gasifier at an additive injection rate, where the CaO additive is comprised of CaO, thereby injecting a quantity of CaO and thereby generating a combined chemical composition in the gasifier, where the combined chemical composition consists of the ash forming species and the quantity of CaO; and establishing the feedstock injection rate and the additive injection rate such that the combined chemical composition is comprised of less than about 25 wt. % $SiO_2$, greater than about 20 wt. % $V_2O_5$, and greater than about 20 wt. % CaO, and such that such that a $SiO_2$—$Al_2O_3$—CaO chemical composition of the ash forming species and the quantity of CaO has a $SiO_2/Al_2O_3$ ratio greater than about 1.3 and less than about 9, and such that the $SiO_2$—$Al_2O_3$—CaO chemical composition is comprised of greater than about 20 wt. % CaO and less than about 50 wt. % CaO, and such that a FeO—CaO—$V_2O_5$ chemical composition of the ash forming species and the quantity of CaO is comprised of less than about 20 wt. % FeO and such that the FeO—CaO—$V_2O_5$ chemical composition has a $CaO/V_2O_5$ ratio greater than about 0.25 and less than about 1.5.

13. The method of claim 12 further comprised of establishing the feedstock injection rate and the additive injection rate such that a $SiO_2$—$V_2O_5$—$Al_2O_3$—CaO chemical composition has a $CaO/(SiO_2+V_2O_5+Al_2O_3+CaO)$ ratio is greater than about 0.2 and less than about 0.5.

14. The method of claim 12 further comprising:

establishing the feedstock injection rate and the additive injection rate to form a slag having a CaO—$SiO_2$—$V_2O_3$ chemical composition comprised of greater than about 20 wt. % CaO and less than about 60 wt. % CaO and having a $V_2O_3$, $SiO_2$ ratio of greater than 1.5 in the CaO—$SiO_2$—$V_2O_3$ chemical composition;

establishing the feedstock injection rate and the additive injection rate to form the slag having a $SiO_2$—$Al_2O_3$—CaO chemical composition comprised of greater than about 20 wt. % and less than about 50 wt. % CaO, and having a $SiO_2/Al_2O_3$ ratio greater than about 1.3 and less than about 9; and establishing the feedstock injection rate and the additive injection rate to form the slag having a FeO—CaO—$V_2O_3$ chemical composition comprised of less than about 20 wt. % FeO, and having a $CaO/V_2O_3$ ratio greater than about 0.25 and less than about 1.5 in the FeO—CaO—$V_2O_3$ chemical composition.

15. The method of claim 12 further comprising;

generating a slag in a reaction zone of the gasifier; and contacting the slag and a refractory lining the reaction zone, where the refractory is comprised of MgO based refractory brick.

* * * * *